US005904199A

United States Patent [19]

Messner

[11] Patent Number: 5,904,199

[45] Date of Patent: May 18, 1999

[54] GARAGE DOOR SCREEN

[76] Inventor: Caroline F. Messner, 400 Maple St. P.O. Box 424, Terre Hill, Pa. 17581

[21] Appl. No.: 09/048,671

[22] Filed: Mar. 26, 1998

[51] Int. Cl.[6] ..... E06B 3/12

[52] U.S. Cl. ..... 160/219; 160/97; 160/127; 160/201; 160/210

[58] Field of Search ..... 160/88, 89, 90, 160/91, 92, 97, 114, 127, 128, 129, 201, 205, 210, 219, 290.1

[56] References Cited

U.S. PATENT DOCUMENTS

| | | | |
|---|---|---|---|
| 101,102 | 3/1870 | Comstock | 160/113 |
| 804,310 | 11/1905 | Garrett | 160/290.1 |
| 939,064 | 11/1909 | McCall et al. | 160/290.1 X |
| 1,078,827 | 11/1913 | Bunnell | 160/290.1 X |
| 2,726,114 | 12/1955 | Jacobi et al. | 160/290.1 X |
| 3,938,577 | 2/1976 | Richards | 160/90 |
| 4,016,920 | 4/1977 | Shepard | 160/201 X |
| 4,231,412 | 11/1980 | Nowak | 160/213 |
| 4,378,043 | 3/1983 | Sorenson | 160/97 |
| 4,574,860 | 3/1986 | Weiss | 160/118 |
| 4,653,566 | 3/1987 | Miale | 160/201 |
| 4,846,241 | 7/1989 | Chomka et al. | 160/23.1 |
| 5,427,169 | 6/1995 | Saulters | 160/368.1 |
| 5,611,382 | 3/1997 | Sferra | 160/201 X |

*Primary Examiner*—Daniel P. Stodola
*Assistant Examiner*—Bruce A. Lev

[57] ABSTRACT

A new garage door screen for allowing for a garage to be ventilated. Also included is a screen door having a generally rectangular configuration. The screen door is defined by a peripheral frame including opposed long upper and lower members and opposed short side members. The peripheral frame has a mesh screen extending therewithin. The long upper member is hingedly secured to a bottom edge of a garage door. The screen door hangs below the bottom edge of the garage door in an open orientation.

2 Claims, 2 Drawing Sheets

FIG. 1
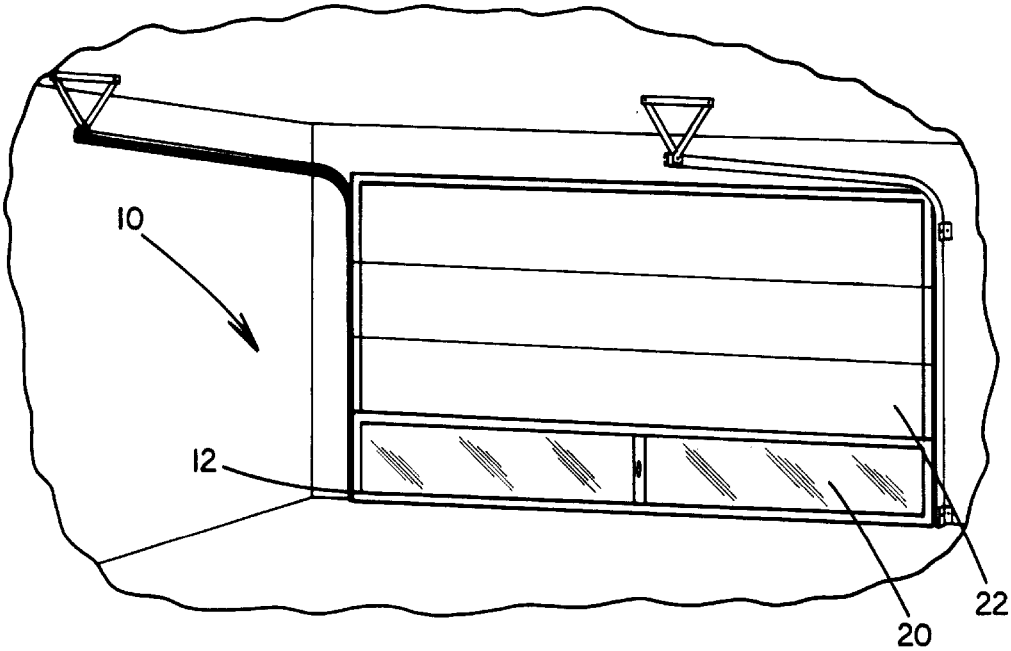
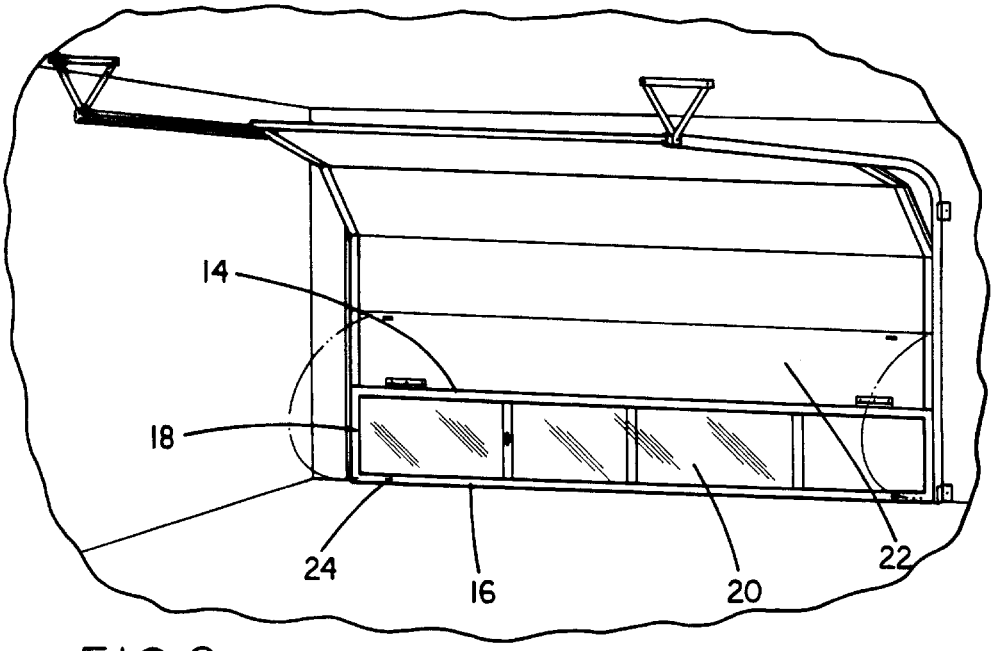
FIG. 2

GARAGE DOOR SCREEN

BACKGROUND OF THE INVENTION

1. Field of the Invention

The present invention relates to screen enclosures and more particularly pertains to a new garage door screen for allowing for a garage to be ventilated.

2. Description of the Prior Art

The use of screen enclosures is known in the prior art. More specifically, screen enclosures heretofore devised and utilized are known to consist basically of familiar, expected and obvious structural configurations, notwithstanding the myriad of designs encompassed by the crowded prior art which have been developed for the fulfillment of countless objectives and requirements.

Known prior art screen enclosures include U.S. Pat. No. 4,846,241 to Chomka et al.; U.S. Pat. No. 4,653,566 to Miale; U.S. Pat. No. 4,231,412 to Nowak; U.S. Pat. No. 5,427,169 to Saulters; U.S. Pat. No. 3,938,577 to Richards; and U.S. Pat. No. Des. 357,071 to Jennings et al.

While these devices fulfill their respective, particular objectives and requirements, the aforementioned patents do not disclose a new garage door screen. The inventive device includes a screen door having a generally rectangular configuration. The screen door is defined by a peripheral frame including opposed long upper and lower members and opposed short side members. The peripheral frame has a mesh screen extending therewithin. The long upper member is hingedly secured to a bottom edge of a garage door. The screen door hangs below the bottom edge of the garage door in an open orientation.

In these respects, the garage door screen according to the present invention substantially departs from the conventional concepts and designs of the prior art, and in so doing provides an apparatus primarily developed for the purpose of allowing for a garage to be ventilated.

SUMMARY OF THE INVENTION

In view of the foregoing disadvantages inherent in the known types of screen enclosures now present in the prior art, the present invention provides a new garage door screen construction wherein the same can be utilized for allowing for a garage to be ventilated.

The general purpose of the present invention, which will be described subsequently in greater detail, is to provide a new garage door screen apparatus and method which has many of the advantages of the screen enclosures mentioned heretofore and many novel features that result in a new garage door screen which is not anticipated, rendered obvious, suggested, or even implied by any of the prior art screen enclosures, either alone or in any combination thereof.

To attain this, the present invention generally comprises a screen door having a generally rectangular configuration. The screen door is defined by a peripheral frame including opposed long upper and lower members and opposed short side members. The peripheral frame has a mesh screen extending therewithin. The long upper member is hingedly secured to a bottom edge of a garage door. The long lower member has a pair of latches disposed on opposing ends thereof. The screen door hangs below the bottom edge of the garage door in an open orientation. A pair of hooks are secured to the garage door upwardly of the bottom edge thereof. The pair of hooks are spaced from the bottom edge of the garage door essentially equal to a height of the screen door. The pair of hooks engage the pair of latches of the screen door in a closed orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garage door screen apparatus and method which has many of the advantages of the screen enclosures mentioned heretofore and many novel features that result in a new garage door screen which is not anticipated, rendered obvious, suggested, or even implied by any of the prior art screen enclosures, either alone or in any combination thereof.

It is another object of the present invention to provide a new garage door screen which may be easily and efficiently manufactured and marketed.

It is a further object of the present invention to provide a new garage door screen which is of a durable and reliable construction.

An even further object of the present invention is to provide a new garage door screen which is susceptible of a low cost of manufacture with regard to both materials and labor, and which accordingly is then susceptible of low prices of sale to the consuming public, thereby making such garage door screen economically available to the buying public.

Still yet another object of the present invention is to provide a new garage door screen which provides in the apparatuses and methods of the prior art some of the advantages thereof, while simultaneously overcoming some of the disadvantages normally associated therewith.

Still another object of the present invention is to provide a new garage door screen for allowing for a garage to be ventilated.

Yet another object of the present invention is to provide a new garage door screen which includes a screen door having a generally rectangular configuration. The screen door is defined by a peripheral frame including opposed long upper and lower members and opposed short side members. The peripheral frame has a mesh screen extending therewithin. The long upper member is hingedly secured to a bottom edge of a garage door. The screen door hangs below the bottom edge of the garage door in an open orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new garage door screen according to the present invention illustrated in a closed orientation.

FIG. 2 is a front view of a new garage door screen according to the present invention illustrated in an open orientation.

DESCRIPTION OF THE PREFERRED EMBODIMENT

Figure 3:
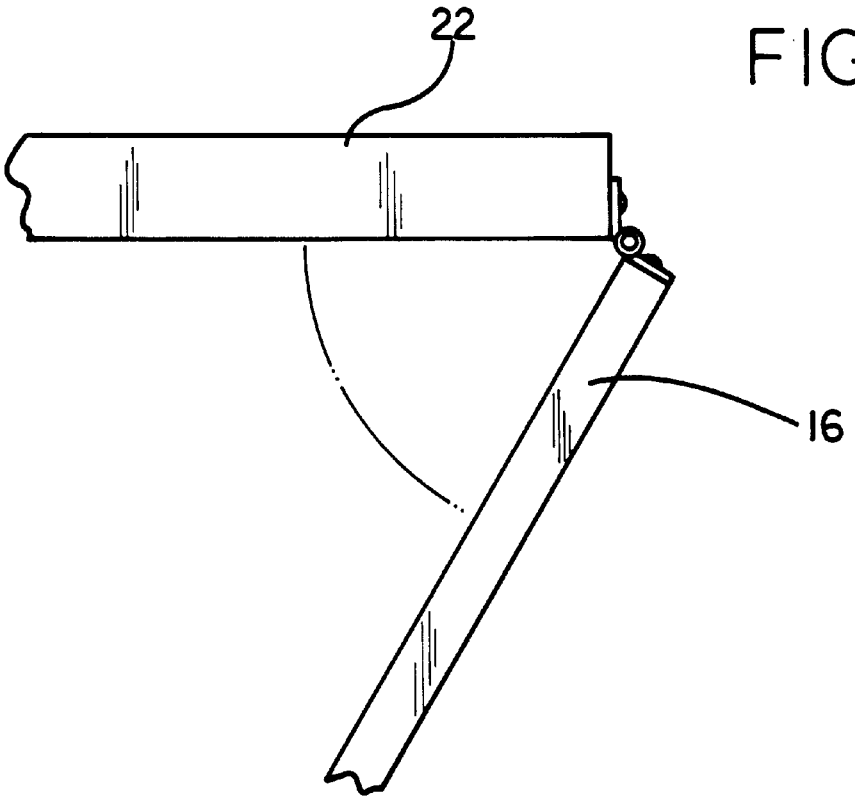
FIG. 3 is a partial side view of the present invention illustrating the hinge coupling of the screen door with the garage door.
Figure 4:
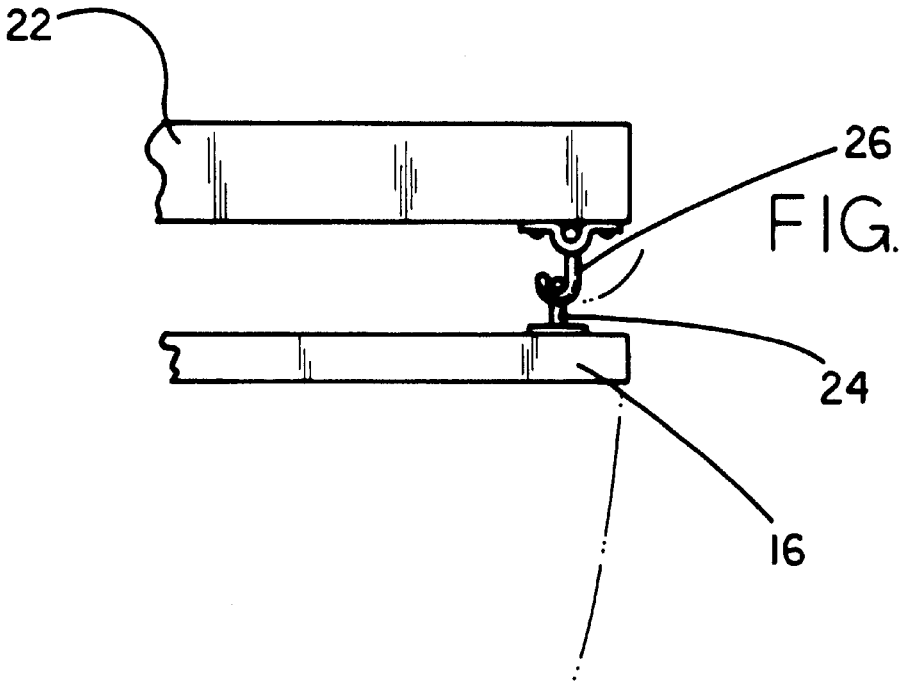
FIG. 4 is a partial side view of the present invention illustrating hook and latch coupling between the screen door and the garage door.

With reference now to the drawings, and in particular to FIGS. 1 through 4 thereof, a new garage door screen embodying the principles and concepts of the present invention and generally designated by the reference numeral 10 will be described.

As best illustrated in FIGS. 1 through 4, the garage door screen 10 comprises a screen door 12 having a generally rectangular configuration. The screen door 12 is defined by a peripheral frame including opposed long upper and lower members 14,16 and opposed short side members 18. The peripheral frame has a mesh screen 20 extending therewithin. The long upper member 14 is hingedly secured to a bottom edge of a garage door 22. The long lower member 16 has a pair of latches 24 disposed on opposing ends thereof. The screen door 12 hangs below the bottom edge of the garage door 22 in an open orientation. The mesh screen 20 is made primarily from a flexible plastic screen material, which would allow air to pass, but would keep debris and pests like insects or small animals from passing. The peripheral frame would be constructed of either plastic or wood and would measure approximately one to three feet in height and would have a length sufficient to span a single or double garage opening.

A pair of hooks 26 are secured to the garage door 22 upwardly of the bottom edge thereof. The pair of hooks 26 are spaced from the bottom edge of the garage door 22 essentially equal to a height of the screen door 12. The pair of hooks 26 engage the pair of latches 24 of the screen door 12 in a closed orientation.

In use, the user would simply raise the garage door 22 a little more than the height of the screen door 12, unlatch the screen door 12, swing it down, and then gently lower the garage door 22 until the long lower member 16 of the screen door 12 makes contact with the ground. When the user wants to close the garage door 22, he or she would only have to swing the screen door 12 up, engage the latches 24 to the hooks 26, and then lower and lock the garage door 22 as usual.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage door screen system for allowing for a garage to be ventilated comprising, in combination:

a garage door comprised of a plurality of horizontally extending sections positioned in a vertical array, each section having top and bottom edges the top and bottom edges of vertically adjacent sections being pivotally linked together;

a screen door having a generally rectangular configuration, the screen door being defined by a peripheral frame including opposed long upper and lower members, opposed short side members, and a central support member connected between a central extent of the upper and lower members, the peripheral frame having a mesh screen extending therewithin, the long upper member hingedly secured to a bottom edge of a vertically lowest section of the vertical array of the garage door via a plurality of hinges each with a first planar portion mounted to the bottom edge of the garage door in generally coplanar relationship therewith and a second planar portion mounted to a top edge of the upper member of the screen door in coplanar relationship therewith, wherein the screen door pivots about an axis coincident with rear extents of the bottom edge of the garage door and the top edge of the screen door, the long lower member having a pair of latches mounted on opposing ends of a rear surface thereof adjacent to a bottom edge of the screen door and extending from the peripheral frame in generally perpendicular relationship therewith, the screen door hanging below the bottom edge of the garage door in an open orientation; and a pair of hooks secured to a rear surface of the lowest section of the garage door upwardly of the bottom edge thereof, the pair of hooks being spaced from the bottom edge of the lowest section of the garage door essentially equal to a height of the screen door, the pair of hooks each including a J-shaped outboard portion and an inboard bracket with a pair of ends mounted on the garage door and a grooved central portion for hingably receiving the outboard portion such that the outboard portion pivots about a horizontal axis, the pair of hooks adapted for engaging the pair of latches of the screen door in a closed orientation;

wherein a vertical height of the screen door is substantially equal to a vertical height of one of the sections of the garage door such that the screen door does not interfere with pivoting of the sections of the garage door when the screen door is positioned in a closed orientation.

2. A garage door screen system as set forth in claim 1 wherein the screen door includes a pair of equally sized panels a first one of which is adapted to slide with respect to a second one of the panels in a lateral direction for allowing unobstructed passage therethrough.

* * * * *